US010176759B2

(12) United States Patent
Chen et al.

(10) Patent No.: US 10,176,759 B2
(45) Date of Patent: Jan. 8, 2019

(54) AMOLED PIXEL DRIVER CIRCUIT AND PIXEL DRIVING METHOD

(71) Applicant: Shenzhen China Star Optoelectronics Technology Co., Ltd., Shenzhen (CN)

(72) Inventors: Xiaolong Chen, Shenzhen (CN); Mingjong Jou, Shenzhen (CN); Yichien Wen, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 16 days.

(21) Appl. No.: 15/328,892

(22) PCT Filed: Dec. 20, 2016

(86) PCT No.: PCT/CN2016/110914
§ 371 (c)(1),
(2) Date: Jan. 24, 2017

(87) PCT Pub. No.: WO2018/072299
PCT Pub. Date: Apr. 26, 2018

(65) Prior Publication Data

US 2018/0211601 A1 Jul. 26, 2018

(30) Foreign Application Priority Data

Oct. 18, 2016 (CN) ..... 2016 1 0912658

(51) Int. Cl.
*G09G 3/3258* (2016.01)
*G09G 3/3225* (2016.01)

(52) U.S. Cl.
CPC ..... *G09G 3/3258* (2013.01); *G09G 3/3225* (2013.01); *G09G 2310/08* (2013.01); *G09G 2320/0233* (2013.01)

(58) Field of Classification Search
None
See application file for complete search history.

(56) References Cited

U.S. PATENT DOCUMENTS 9,478,169 B2 * 10/2016 Lim ..... G09G 3/3258
2006/0119548 A1 * 6/2006 Lan ..... G09G 3/3233 345/76
2016/0104424 A1 * 4/2016 Lim ..... G09G 3/3258 345/76

FOREIGN PATENT DOCUMENTS

CN 103000127 A 3/2013

* cited by examiner

*Primary Examiner* — Kenneth B Lee, Jr.
(74) *Attorney, Agent, or Firm* — Leong C. Lei

(57) ABSTRACT

The invention provides an AMOLED pixel driver circuit and pixel driving method. The AMOLED pixel driver circuit has a 6T1C structure, comprising a first thin film transistor (TFT) (T1), a second TFT (T2) forming mirror relation with the first TFT (T1), a third TFT (T3), a fourth TFT (T4), a fifth TFT (T5), a sixth TFT (T6), a capacitor (C1), and an organic light-emitting diode (OLED) (D1), and receiving a first scan signal (Scan1), a second scan signal (Scan2), a third scan signal (Scan3), a light-emitting signal (EM), a data signal (Data), and a reference voltage (Vref). The circuit can effectively compensate the threshold voltage of the driving TFT to solve the problem of unstable current flowing through the OLED caused by the threshold voltage drift to ensure uniform luminance of the OLED and improve the display quality.

8 Claims, 6 Drawing Sheets

AMOLED PIXEL DRIVER CIRCUIT AND PIXEL DRIVING METHOD

BACKGROUND OF THE INVENTION

1. Field of the Invention

The present invention relates to the field of display techniques, and in particular to an AMOLED pixel driver and pixel driving method.

2. The Related Arts

The organic light emitting diode (OLED) display provides the advantages of active light-emitting, low driving voltage, high emission efficiency, quick response time, high resolution and contrast, near 180° viewing angle, wide operation temperature range, and capability to realize flexible display and large-area full-color display, and is regarded as the most promising display technology.

The driving types of OLED can be divided, according to the driving method, into the passive matrix OLED (PMOLED) and active matrix OLED (AMOLED), i.e., the direct addressable type and thin film transistor (TFT) addressable type, wherein the AMOLED provides the advantages of pixels arranged in an array, self-luminous, and high luminous efficiency and is commonly used for high definition large-size display.

AMOLED is a current-driven device that emits light when a current flows through the OLED, and the light-emitting luminance is determined by the current flowing through the OLED. Most of the known integrated circuits (ICs) only transmit voltage signals, so the AMOLED pixel driver circuit needs to complete the task of converting the voltage signal into a current signal.

The known AMOLED pixel driver circuit is usually 2T1C structure, that is, two thin film transistors (TFTs) and a capacitor. As shown in FIG. 1, a known 2T1C pixel driver circuit for AMOLED with a compensation function comprises a first TFT T10, a second TFT T20, a capacitor C10, and an OLED D10, wherein the first TFT T10 has the gate connected to the drain of the second TFT T20, the drain connected to a power supply positive voltage OVDD, and the source connected to the anode of the OLED D10; the second TFT T20 has the gate connected to a gate driving signal Gate, the source connected to a data signal Data and the drain connected to the gate of the first TFT T10; the capacitor C10 has one end connected to the gate of the first TFT T10 and the other connected to the drain of the first TFT T10; the OLED D10 has the anode connected to the source of the first TFT T10 and the cathode connected to the power supply negative voltage OVSS. When the 2T1C-structured AMOLED pixel driver circuit operates, the current flowing through the OLED D10 is:

$$I=k\times(Vgs-Vth)^2$$

Wherein I is the current flowing through the OLED D10, k is a constant coefficient related to the characteristics of the first TFT T10, Vgs is the voltage difference between the gate and the source of the driving TFT (i.e., the first TFT T10), Vth is the threshold voltage of the voltage of the driving TFT (i.e., the first TFT T10). As seen, the current flowing through the OLED D10 is related to the threshold voltage of the driving TFT.

Because of the instability of the panel fabrication process, making the threshold voltage of the driving TFT in each pixel drive circuit within the panel maybe different, and the material of TFT will age after prolonged use and result in changes to cause threshold voltage drift of the driving TFT and lead to unstable current flowing through the OLED and causes non-uniformity of panel display. In the known 2T1C circuit, the threshold voltage drift of the driving TFT cannot be improved by adjustment. Therefore, it is necessary to add the new TFT or the new signal to alleviate the influence of the threshold voltage drift, to make the pixel driver circuit have a compensation function.

SUMMARY OF THE INVENTION

The object of the present invention is to provide an AMOLED pixel driver circuit, able to effectively compensate the threshold voltage drift of the driving TFT to stabilize the current flowing through the OLED and to ensure even light-emitting of the OLED to improve display result.

Another object of the present invention is to provide an AMOLED pixel driving method, able to effectively compensate the threshold voltage change of the driving TFT to solve the problem of unstable current flowing through the OLED caused by the threshold voltage drift so as to ensure uniform light-emitting of the OLED to improve display result.

To achieve the above object, the present invention provides an AMOLED driver circuit, which comprises: a first thin film transistor (TFT), a second TFT, a third TFT, a fourth TFT, a fifth TFT, a sixth TFT, a capacitor, and an organic light-emitting diode (OLED);

the first TFT having the gate connected to a first node, the source connected to a second node and the drain connected to a third node;

the second TFT having the gate connected to a first scan signal, the source connected to a reference voltage, the drain connected to the first node;

the third TFT having the gate connected to a second scan signal, the source connected to a data signal and the drain connected to the second node;

the fourth TFT having the gate connected to a third scan signal, the source connected to the first node and the drain connected to the third node;

the fifth TFT having the gate connected to a light-emitting signal, the source connected to a power supply positive voltage and the drain connected to the third node;

the sixth TFT having the gate connected to the light-emitting signal, the source connected to the second node and the drain connected to the anode of the OLED;

the capacitor having one end connected to the first node and the other end connected to the ground;

the OLED having the anode connected to the drain of the sixth TFT and the cathode connected to the power supply negative voltage.

According to a preferred embodiment of the present invention, the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

According to a preferred embodiment of the present invention, the first scan signal, the second scan signal, the third scan signal and the light-emitting signal are all provided by an external timing controller.

According to a preferred embodiment of the present invention, the first scan signal, the second scan signal, the third scan signal, the light-emitting signal and the data signal are combined to correspond to, in sequence, an initialization phase, a threshold voltage detection phase and a driving light-emitting phase.

According to a preferred embodiment of the present invention, the first TFT, the second TFT, the third TFT, the fourth TFT, the fifth TFT and the sixth TFT are all N-type TFTs;

in the initialization phase, the first scan signal provides high level voltage, the second scan signal provides high level voltage, the third scan signal provides low level voltage, the light-emitting signal provides low level voltage, and the data signal provides an initialization voltage;

in the threshold voltage detection phase, the first scan signal provides low level voltage, the second scan signal provides high level voltage, the third scan signal provides high level voltage, the light-emitting signal provides low level voltage, and the data signal provides a display data voltage;

in the driving light-emitting phase, the first scan signal, the second scan signal and the third scan signal all provide low level voltage, and the light-emitting signal provides high level voltage.

Another embodiment of the present invention provides an AMOLED pixel driving method, which comprises:

Step 1: providing an AMOLED pixel driver circuit, comprising:

a first thin film transistor (TFT), a second TFT, a third TFT, a fourth TFT, a fifth TFT, a sixth TFT, a capacitor, and an organic light-emitting diode (OLED);

the first TFT having the gate connected to a first node, the source connected to a second node and the drain connected to a third node;

the second TFT having the gate connected to a first scan signal, the source connected to a reference voltage, the drain connected to the first node;

the third TFT having the gate connected to a second scan signal, the source connected to a data signal and the drain connected to the second node;

the fourth TFT having the gate connected to a third scan signal, the source connected to the first node and the drain connected to the third node;

the fifth TFT having the gate connected to a light-emitting signal, the source connected to a power supply positive voltage and the drain connected to the third node;

the sixth TFT having the gate connected to the light-emitting signal, the source connected to the second node and the drain connected to the anode of the OLED;

the capacitor having one end connected to the first node and the other end connected to the ground;

the OLED having the anode connected to the drain of the sixth TFT and the cathode connected to the power supply negative voltage;

Step 2: entering an initialization phase:

the first scan signal turning on the second TFT; the second scan signal turning on the third TFT; the third scan signal cutting off the fourth TFT; the light-emitting signal cutting off the fifth TFT and the sixth TFT; the data signal providing an initialization voltage, a reference voltage being written into the first node and the initialization voltage being written into the second node;

Step 3: entering a threshold voltage detection phase:

the first scan signal cutting off the second TFT; the second scan signal turning on the third TFT; the third scan signal turning on the fourth TFT; the light-emitting signal cutting off the fifth TFT and the sixth TFT; the data signal providing a display data voltage; the turned on fourth TFT connecting the gate and the drain of the first TFT; the voltage of the first node reaching the sum of the display data voltage and the threshold voltage of the first TFT; and the voltage of the first node being stored in the capacitor;

Step 4: entering a driving light-emitting phase:

the first scan signal, the second scan signal and the third scan signal cutting off the second TFT, the third TFT and the fourth TFT respectively; the light-emitting signal turning on the fifth TFT and the sixth TFT; the storage effect of the capacitor making the voltage of the first node maintaining the sum of the display data voltage and the threshold voltage of the first TFT; a power supply positive voltage being written into the third node; the first TFT being turned on, the OLED emitting light, and the current flowing through the OLED being independent of the threshold voltage of the first TFT.

According to a preferred embodiment of the present invention, the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

According to a preferred embodiment of the present invention, the first scan signal, the second scan signal, the third scan signal and the light-emitting signal are all provided by an external timing controller.

According to a preferred embodiment of the present invention, the first TFT, the second TFT, the third TFT, the fourth TFT, the fifth TFT and the sixth TFT are all N-type TFTs;

in the initialization phase, the first scan signal provides high level voltage, the second scan signal provides high level voltage, the third scan signal provides low level voltage, the light-emitting signal provides low level voltage, and the data signal provides an initialization voltage;

in the threshold voltage detection phase, the first scan signal provides low level voltage, the second scan signal provides high level voltage, the third scan signal provides high level voltage, the light-emitting signal provides low level voltage, and the data signal provides a display data voltage;

in the driving light-emitting phase, the first scan signal, the second scan signal and the third scan signal all provide low level voltage, and the light-emitting signal provides high level voltage.

Yet another embodiment of the present invention provides an AMOLED driver circuit, which comprises: a first thin film transistor (TFT), a second TFT, a third TFT, a fourth TFT, a fifth TFT, a sixth TFT, a capacitor, and an organic light-emitting diode (OLED);

the first TFT having the gate connected to a first node, the source connected to a second node and the drain connected to a third node;

the second TFT having the gate connected to a first scan signal, the source connected to a reference voltage, the drain connected to the first node;

the third TFT having the gate connected to a second scan signal, the source connected to a data signal and the drain connected to the second node;

the fourth TFT having the gate connected to a third scan signal, the source connected to the first node and the drain connected to the third node;

the fifth TFT having the gate connected to a light-emitting signal, the source connected to a power supply positive voltage and the drain connected to the third node;

the sixth TFT having the gate connected to the light-emitting signal, the source connected to the second node and the drain connected to the anode of the OLED;

the capacitor having one end connected to the first node and the other end connected to the ground;

the OLED having the anode connected to the drain of the sixth TFT and the cathode connected to the power supply negative voltage;

wherein the first TFT, the second TFT, the third TFT, the fourth TFT, the fifth TFT and the sixth TFT being all low temperature polysilicon (LTPS) TFTs, oxide semiconductor TFTs or amorphous silicon (a-Si) TFTs;

wherein the first scan signal, the second scan signal, the third scan signal and the light-emitting signal being all provided by an external timing controller.

Compared to the known techniques, the present invention provides the following advantages. The present invention provides an AMOLED pixel driver circuit of 6T1C structure. In the initialization phase, the second TFT and the third TFT are turned on, and the fourth, fifth and sixth TFTs are cut off so that the reference voltage is written into the agate of the first TFT and the initialization voltage written into the source. In the threshold voltage detection phase, the third and the fourth TFTs are turned on, and the second, fifth and sixth TFTs are cut off so that the voltage of the gate of the first TFT rises to the sum of the display data voltage and the threshold voltage of the TFT and is stored to the capacitor. In the driving light-emitting phase, the fifth and sixth TFTs are cut off. The storage of the capacitor keeps the voltage of the gate of the first TFT at the sum of the display data voltage and the threshold voltage of the TFT. The first TFT is turned on so that the OLED emits light, and the current flowing through the OLED is independent of the threshold voltage of the first TFT so as to ensure uniform luminance of the OLED and improve display result. The present invention provides an AMOLED pixel driving method able to effectively compensate the threshold voltage change of the driving TFT to solve the problem of unstable current flowing through the OLED caused by the threshold voltage drift so as to ensure uniform light-emitting of the OLED to improve display result.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
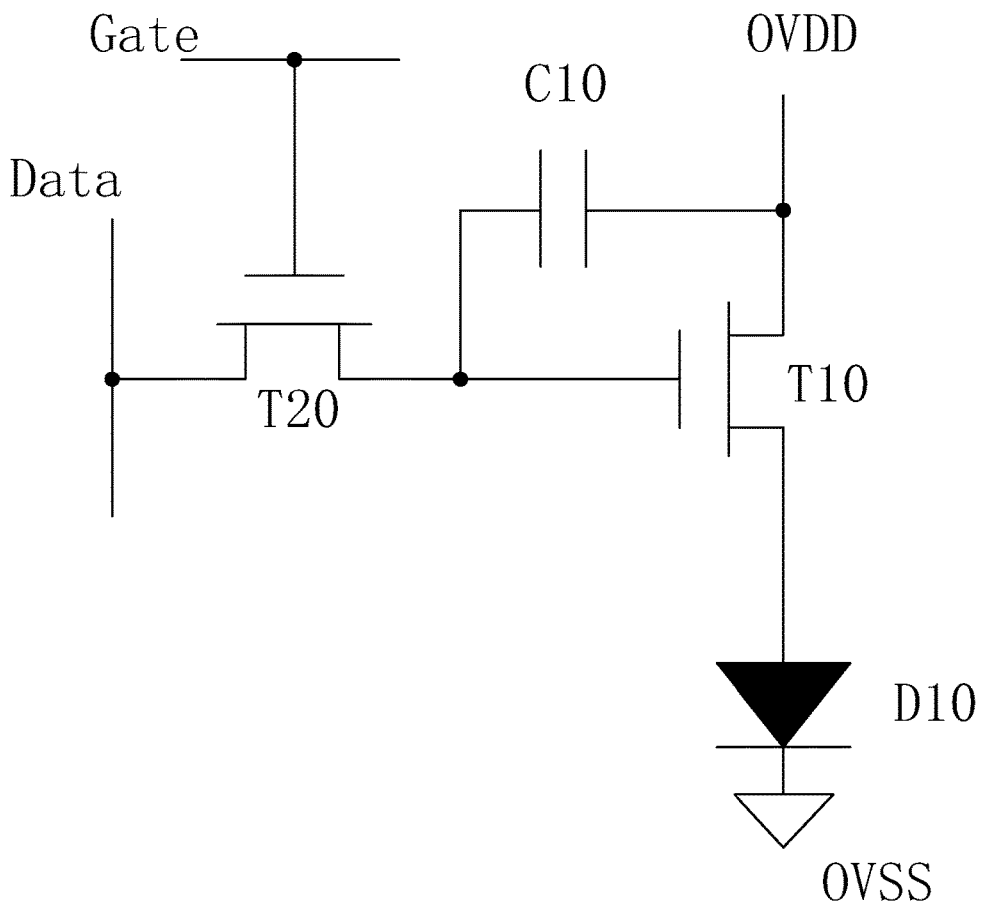
FIG. 1 is a schematic view showing a known AMOLED pixel driver circuit of 2T1C structure.
Figure 2:
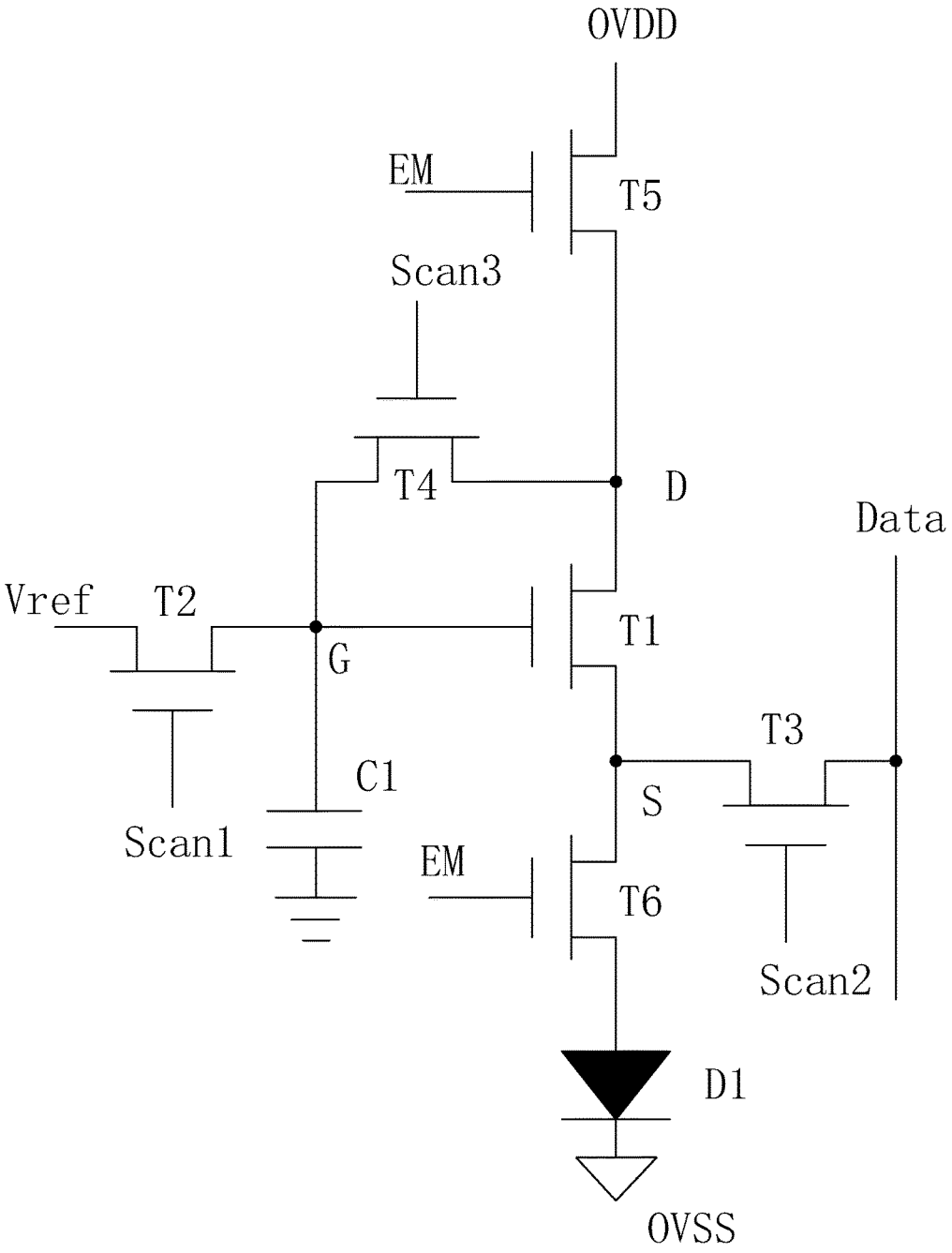
FIG. 2 is a schematic view showing a pixel driver circuit for AMOLED provided by an embodiment of the present invention.

Referring to FIG. 1 and FIG. 2, the present invention provides an AMOLED pixel driver circuit of 6T1C structure, which comprises: a first thin film transistor (TFT) T1, a second TFT T2, a third TFT T3, a fourth TFT T4, a fifth TFT T5, a sixth TFT T6, a capacitor C1, and an organic light-emitting diode (OLED) D1.

The first TFT T1 the gate connected to a first node G, the source connected to a second node S and the drain connected to a third node D.

The second TFT T2 has the gate connected to a first scan signal Scan1, the source connected to a reference voltage Vref, the drain connected to the first node G.

The third TFT T3 has the gate connected to a second scan signal Scan2, the source connected to a data signal Data and the drain connected to the second node S.

The fourth TFT T4 has the gate connected to a third scan signal Scan3, the source connected to the first node G and the drain connected to the third node D.

The fifth TFT T5 has the gate connected to a light-emitting EM signal, the source connected to a power supply positive voltage OVDD and the drain connected to the third node D.

The sixth TFT T6 has the gate connected to the light-emitting signal EM, the source connected to the second node S and the drain connected to the anode of the OLED D1.

The capacitor C1 has one end connected to the first node G and the other end connected to the ground.

The OLED D1 has the anode connected to the drain of the sixth TFT T6 and the cathode connected to the power supply negative voltage OVSS.

Specifically, the first TFT T1, the second TFT T2, the third TFT T3, the fourth TFT T4, the fifth TFT T5 and the sixth TFT T6 are all low temperature polysilicon (LTPS) TFTs, oxide semiconductor TFTs or amorphous silicon (a-Si) TFTs.

Specifically, the first scan signal Scan1, the second scan signal Scan2, the third scan signal Scan3 and the light-emitting signal EM are all provided by an external timing controller.

Specifically, the first scan signal Scan1, the second scan signal Scan2, the third scan signal Scan3, the light-emitting signal EM and the data signal Data are combined to correspond to, in sequence, an initialization phase 1, a threshold voltage detection phase 2 and a driving light-emitting phase 3.

Furthermore, referring to FIGS. 4-6, the operation of the process of the AMOLED pixel driver circuit of the present invention is as follows:

In the initialization phase 1, the first scan signal Scan1 turns on the second TFT T2, the second scan signal Scan2 turns on the third TFT T3, the third scan signal cuts off the fourth TFT T4, the light-emitting signal EM cuts off the fifth TFT T5 and the sixth TFT T6, and the data signal Data provides an initialization voltage Vini; the reference voltage Vini is written into the second node S (i.e., the source of the first TFT T1) via the turned on third TFT T3, a reference voltage Vref is written into the first node G (i.e., the gate of the first TFT T1) via the turned on second TFT T2 to accomplish the initialization of the gate and the source of the first TFT T1.

In the threshold voltage detection phase 2, the first scan signal Scan1 cuts off the second TFT T2; the second scan signal Scan2 turns on the third TFT T3 the third scan signal Scan3 turns on the fourth TFT T4; the light-emitting signal EM cuts off the fifth TFT T5 and the sixth TFT T6; the data signal Data provides a display data voltage Vdata; the turned on fourth TFT T4 connects the gate and the drain of the first TFT T1; the voltage of the first node G (i.e., the gate of the first TFT T1) reaches, due to the continuous discharge of the source of the first TFT T1, the sum of the display data voltage Vdata and the threshold voltage of the first TFT T1, that is, Vg=Vs+Vth=Vdata+Vth, wherein Vg is the gate voltage of the first TFT T1, Vs is the source voltage of the first TFT T1, Vdata is the display data voltage, Vth is the threshold voltage of the first TFT t1; at this point, the voltage of the gate of the first TFT T1 is stored in the capacitor C1.

In the driving light-emitting phase 3, the first scan signal Scan1, the second scan signal Scan2 and the third scan signal Scan3 cut off the second TFT T2, the third TFT T3 and the fourth TFT T4 respectively; the light-emitting signal EM turns on the fifth TFT T5 and the sixth TFT T6; the storage effect of the capacitor C1 makes the voltage of the first node G (i.e., the gate of the first TFT T1) maintaining the sum of the display data voltage Vdata and the threshold voltage of the first TFT T1; a power supply positive voltage OVDD is written into the third node D (i.e., the drain of the first TFT T1) via the turned on fifth TFT T5; the first TFT T1 is turned on, the OLED D1 emits light.

Furthermore, the equation to compute the current flowing through the OLED D1 is:

$$I=k\times(Vgs-Vth)^2 \quad (1)$$

Wherein I is the current flowing through the OLED D1, k is a constant coefficient related to the characteristics of the first TFT T1 (i.e., the driving TFT), Vgs is the voltage difference between the gate and the source of the driving TFT (i.e., the first TFT T1), Vth is the threshold voltage of the voltage of the driving TFT (i.e., the first TFT T1). As seen, the current flowing through the OLED D10 is related to the threshold voltage of the driving TFT.

$$\text{As } Vgs=V\text{data}+Vth \quad (2)$$

Substituting (2) into (1) to obtain:

$$\begin{aligned} I &= k\times(Vgs-Vth)^2 \\ &= k\times(Vdata+Vth-Vs-Vth)^2 \\ &= k\times(Vdata-Vs)^2 \end{aligned}$$

As shown, the current flowing through the OLED D1 is independent of the threshold voltage Vth of the first TFT T1. The compensation of the threshold voltage drift of the driving TFT also solves the problem of unstable current flowing through the OLED caused by the threshold voltage drift so as to ensure uniform light-emitting of the OLED to improve display result.

Furthermore, a preferred embodiment of the present invention, the first TFT T1, the second TFT T2, the third TFT T3, the fourth TFT T4, the fifth TFT T5 and the sixth TFT T6 are all N-type TFTs. In the initialization phase 1, the first scan signal Scan1 provides high level voltage, the second scan signal Scan2 provides high level voltage, the third scan signal Scan3 provides low level voltage, the light-emitting signal EM provides low level voltage, and the data signal Data provides an initialization voltage Vini; in the threshold voltage detection phase 2, the first scan signal Scan1 provides low level voltage, the second scan signal Scan2 provides high level voltage, the third scan signal Scan3 provides high level voltage, the light-emitting signal EM provides low level voltage, and the data signal Data provides a display data voltage Vdata; in the driving light-emitting phase 3, the first scan signal Scan1, the second scan signal Scan2 and the third scan signal Scan3 all provide low level voltage, and the light-emitting signal EM provides high level voltage.

Figure 3:
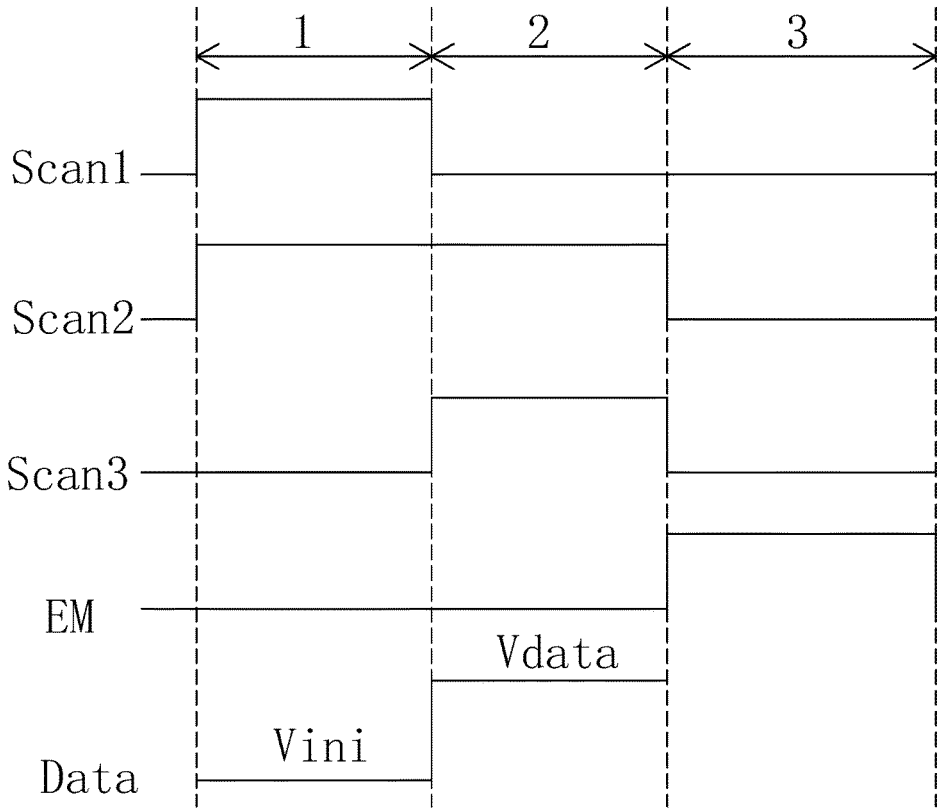
FIG. 3 is a schematic view showing the timing sequence of the pixel driver circuit for AMOLED provided by an embodiment of the present invention.
Figure 4:
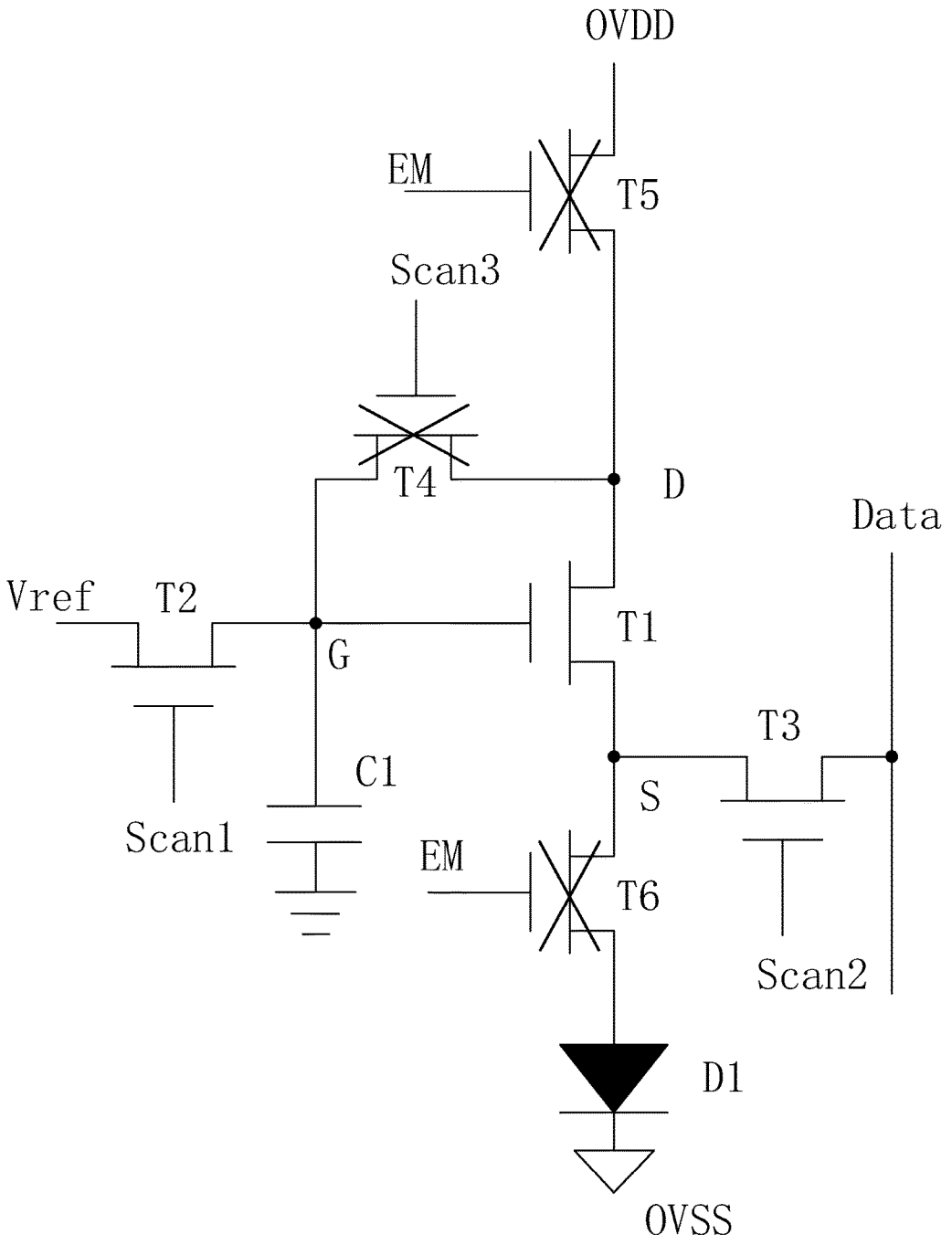
FIG. 4 is a schematic view showing Step 2 of the AMOLED pixel driving method provided by an embodiment of the present invention.
Figure 5:
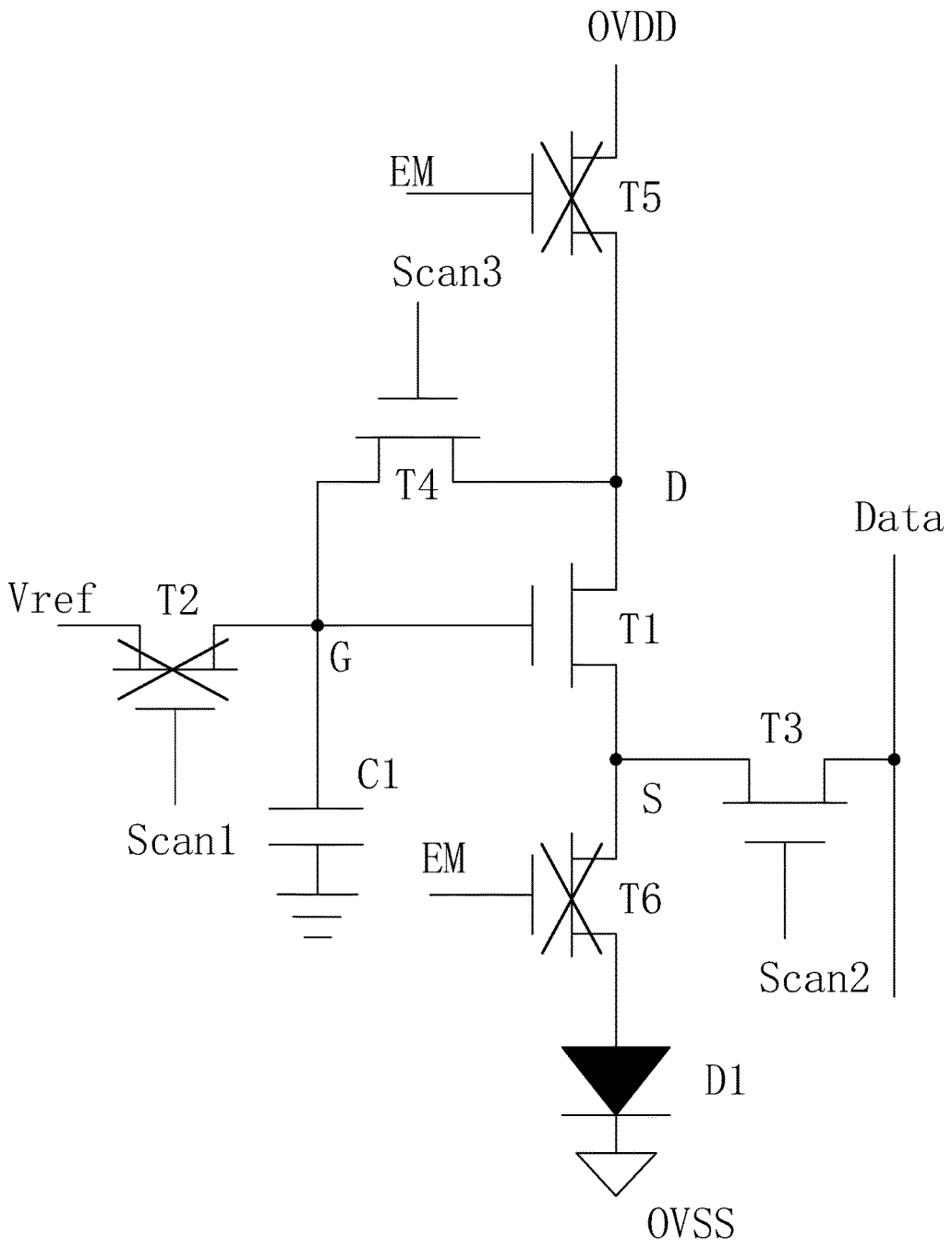
FIG. 5 is a schematic view showing Step 3 of the AMOLED pixel driving method provided by an embodiment of the present invention.
Figure 6:
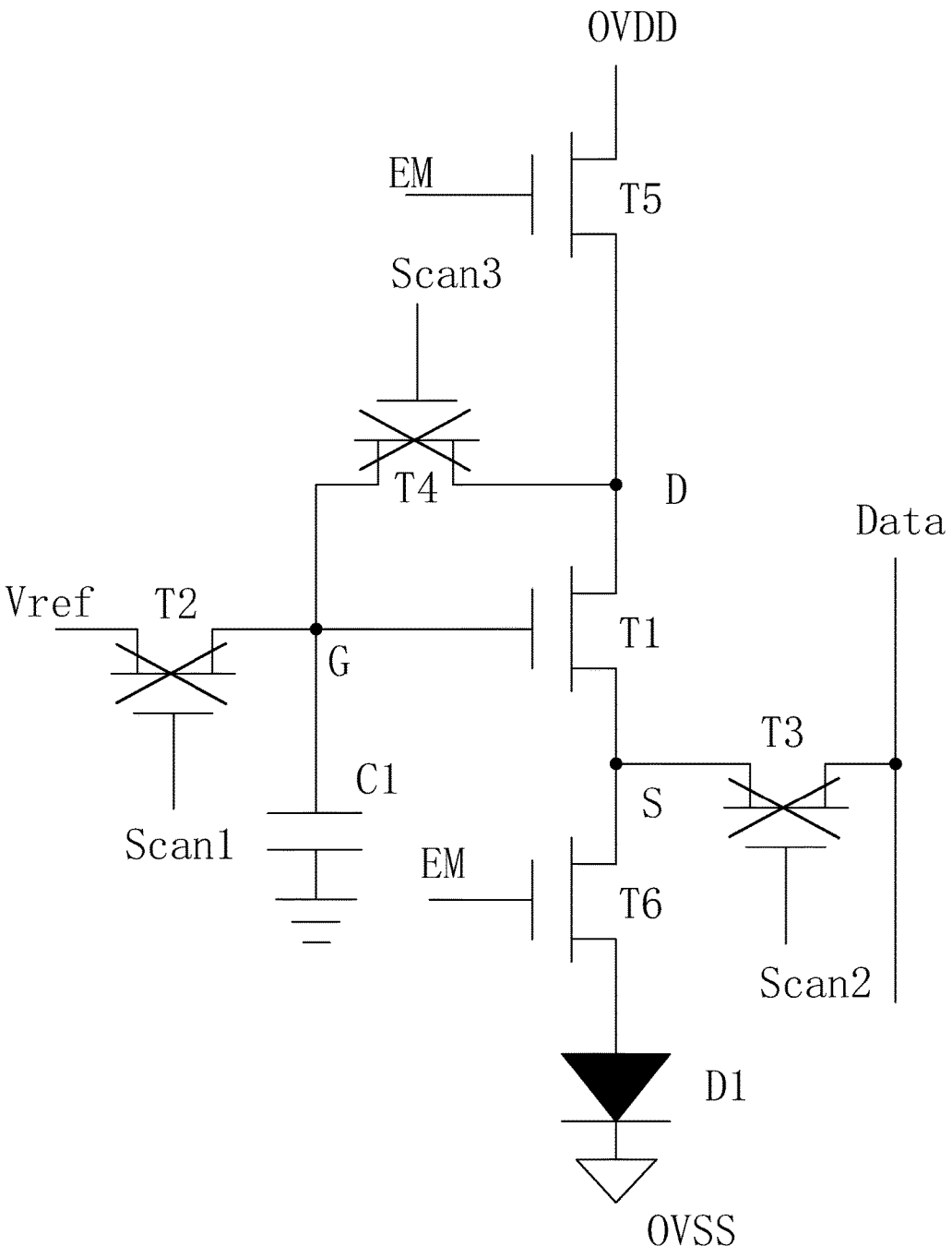
FIG. 6 is a schematic view showing Step 4 of the AMOLED pixel driving method provided by an embodiment of the present invention.

Refer to FIGS. 4-6, in combination with FIGS. 2-3. Based on the aforementioned AMOLED pixel driver circuit, the present invention also provides an AMOLED pixel driving method, which comprises the following steps:

Step 1: Providing an AMOLED Pixel Driver Circuit.

The AMOLED pixel driver circuit comprises: a first thin film transistor (TFT) T1, a second TFT T2, a third TFT T3, a fourth TFT T4, a fifth TFT T5, a sixth TFT T6, a capacitor C1, and an organic light-emitting diode (OLED) D1.

The first TFT T1 the gate connected to a first node G, the source connected to a second node S and the drain connected to a third node D.

The second TFT T2 has the gate connected to a first scan signal Scan1, the source connected to a reference voltage Vref, the drain connected to the first node G.

The third TFT T3 has the gate connected to a second scan signal Scan2, the source connected to a data signal Data and the drain connected to the second node S.

The fourth TFT T4 has the gate connected to a third scan signal Scan3, the source connected to the first node G and the drain connected to the third node D.

The fifth TFT T5 has the gate connected to a light-emitting EM signal, the source connected to a power supply positive voltage OVDD and the drain connected to the third node D.

The sixth TFT T6 has the gate connected to the light-emitting signal EM, the source connected to the second node S and the drain connected to the anode of the OLED D1.

The capacitor C1 has one end connected to the first node G and the other end connected to the ground.

The OLED D1 has the anode connected to the drain of the sixth TFT T6 and the cathode connected to the power supply negative voltage OVSS.

Wherein, the first TFT T1 is the driving TFT for driving the OLED D1 to emit light.

Specifically, the first TFT T1, the second TFT T2, the third TFT T3, the fourth TFT T4, the fifth TFT T5 and the sixth TFT T6 are all low temperature polysilicon (LTPS) TFTs, oxide semiconductor TFTs or amorphous silicon (a-Si) TFTs.

Specifically, the first scan signal Scan1, the second scan signal Scan2, the third scan signal Scan3 and the light-emitting signal EM are all provided by an external timing controller.

Step 2: Entering Initialization Phase 1.

The first scan signal Scan1 turns on the second TFT T2, the second scan signal Scan2 turns on the third TFT T3, the third scan signal cuts off the fourth TFT T4, the light-emitting signal EM cuts off the fifth TFT T5 and the sixth TFT T6, and the data signal Data provides an initialization voltage Vini; the reference voltage Vini is written into the second node S (i.e., the source of the first TFT T1) via the turned on third TFT T3, a reference voltage Vref is written into the first node G (i.e., the gate of the first TFT T1) via the turned on second TFT T2 to accomplish the initialization of the gate and the source of the first TFT T1.

Step 3: Entering Threshold Voltage Detection Phase 2.

The first scan signal Scan1 cuts off the second TFT T2; the second scan signal Scan2 turns on the third TFT T3 the third scan signal Scan3 turns on the fourth TFT T4; the light-emitting signal EM cuts off the fifth TFT T5 and the sixth TFT T6; the data signal Data provides a display data voltage Vdata; the turned on fourth TFT T4 connects the gate and the drain of the first TFT T1; the voltage of the first node G (i.e., the gate of the first TFT T1) reaches, due to the continuous discharge of the source of the first TFT T1, the sum of the display data voltage Vdata and the threshold voltage of the first TFT T1, that is, Vg=Vs+Vth=Vdata+Vth, wherein Vg is the gate voltage of the first TFT T1, Vs is the source voltage of the first TFT T1, Vdata is the display data voltage, Vth is the threshold voltage of the first TFT t1; at this point, the voltage of the gate of the first TFT T1 is stored in the capacitor C1.

Step 4: Entering Driving Light-Emitting Phase 3.

The first scan signal Scan1, the second scan signal Scan2 and the third scan signal Scan3 cut off the second TFT T2, the third TFT T3 and the fourth TFT T4 respectively; the light-emitting signal EM turns on the fifth TFT T5 and the sixth TFT T6; the storage effect of the capacitor C1 makes the voltage of the first node G (i.e., the gate of the first TFT T1) maintaining the sum of the display data voltage Vdata and the threshold voltage of the first TFT T1; a power supply positive voltage OVDD is written into the third node D (i.e., the drain of the first TFT T1) via the turned on fifth TFT T5; the first TFT T1 is turned on, the OLED D1 emits light.

Furthermore, the equation to compute the current flowing through the OLED D1 is:

$$I=k\times(Vgs-Vth)^2 \quad (1)$$

Wherein I is the current flowing through the OLED D1, k is a constant coefficient related to the characteristics of the first TFT T1 (i.e., the driving TFT), Vgs is the voltage difference between the gate and the source of the driving TFT (i.e., the first TFT T1), Vth is the threshold voltage of the voltage of the driving TFT (i.e., the first TFT T1). As seen, the current flowing through the OLED D10 is related to the threshold voltage of the driving TFT.

$$\text{As } Vgs=V\text{data}+Vth \quad (2)$$

Substituting (2) into (1) to obtain:

$$\begin{aligned} I &= k\times(Vgs-Vth)^2 \\ &= k\times(Vdata+Vth-Vs-Vth)^2 \\ &= k\times(Vdata-Vs)^2 \end{aligned}$$

As shown, the current flowing through the OLED D1 is independent of the threshold voltage Vth of the first TFT T1. The compensation of the threshold voltage drift of the driving TFT also solves the problem of unstable current flowing through the OLED caused by the threshold voltage drift so as to ensure uniform light-emitting of the OLED to improve display result.

Furthermore, a preferred embodiment of the present invention, the first TFT T1, the second TFT T2, the third TFT T3, the fourth TFT T4, the fifth TFT T5 and the sixth TFT T6 are all N-type TFTs. In the initialization phase 1, the first scan signal Scan1 provides high level voltage, the second scan signal Scan2 provides high level voltage, the third scan signal Scan3 provides low level voltage, the light-emitting signal EM provides low level voltage, and the data signal Data provides an initialization voltage Vini; in the threshold voltage detection phase 2, the first scan signal Scan1 provides low level voltage, the second scan signal Scan2 provides high level voltage, the third scan signal Scan3 provides high level voltage, the light-emitting signal EM provides low level voltage, and the data signal Data provides a display data voltage Vdata; in the driving light-emitting phase 3, the first scan signal Scan1, the second scan signal Scan2 and the third scan signal Scan3 all provide low level voltage, and the light-emitting signal EM provides high level voltage.

In summary, the present invention provides an AMOLED pixel driver circuit of 6T1C structure. In the initialization phase, the second TFT and the third TFT are turned on, and the fourth, fifth and sixth TFTs are cut off so that the reference voltage is written into the agate of the first TFT and the initialization voltage written into the source. In the threshold voltage detection phase, the third and the fourth TFTs are turned on, and the second, fifth and sixth TFTs are cut off so that the voltage of the gate of the first TFT rises to the sum of the display data voltage and the threshold voltage of the TFT and is stored to the capacitor. In the driving light-emitting phase, the fifth and sixth TFTs are cut off. The storage of the capacitor keeps the voltage of the gate of the first TFT at the sum of the display data voltage and the threshold voltage of the TFT. The first TFT is turned on so that the OLED emits light, and the current flowing through the OLED is independent of the threshold voltage of the first TFT so as to ensure uniform luminance of the OLED and improve display result. The present invention provides an AMOLED pixel driving method able to effectively compensate the threshold voltage change of the driving TFT to solve the problem of unstable current flowing through the OLED caused by the threshold voltage drift so as to ensure uniform light-emitting of the OLED to improve display result.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. An active matrix organic light-emitting diode (AMOLED) pixel driver circuit, which comprises: a first thin film transistor (TFT), a second TFT, a third TFT, a fourth TFT, a fifth TFT, a sixth TFT, a capacitor, and an organic light-emitting diode (OLED);

the first TFT having the gate connected to a first node, the source connected to a second node and the drain connected to a third node;

the second TFT having the gate connected to a first scan signal, the source connected to a reference voltage, the drain connected to the first node;

the third TFT having the gate connected to a second scan signal, the source connected to a data signal and the drain connected to the second node;

the fourth TFT having the gate connected to a third scan signal, the source connected to the first node and the drain connected to the third node;

the fifth TFT having the gate connected to a light-emitting signal, the source connected to a power supply positive voltage and the drain connected to the third node;

the sixth TFT having the gate connected to the light-emitting signal, the source connected to the second node and the drain connected to the anode of the OLED;

the capacitor having one end connected to the first node and the other end connected to the ground;

the OLED having the anode connected to the drain of the sixth TFT and the cathode connected to the power supply negative voltage;

wherein the first scan signal, the second scan signal, the third scan signal, the light-emitting signal and the data signal are combined to correspond to, in sequence, an initialization phase, a threshold voltage detection phase and a driving light-emitting phase;

wherein the first TFT, the second TFT, the third TFT, the fourth TFT, the fifth TFT and the sixth TFT are all N-type TFTs;

in the initialization phase, the first scan signal provides high level voltage, the second scan signal provides high level voltage, the third scan signal provides low level voltage, the light-emitting signal provides low level voltage, and the data signal provides an initialization voltage;

in the threshold voltage detection phase, the first scan signal provides low level voltage, the second scan signal provides high level voltage, the third scan signal provides high level voltage, the light-emitting signal provides low level voltage, and the data signal provides a display data voltage;

in the driving light-emitting phase, the first scan signal, the second scan signal and the third scan signal all provide low level voltage, and the light-emitting signal provides high level voltage.

2. The AMOLED pixel driver circuit as claimed in claim 1, wherein the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

3. The AMOLED pixel driver circuit as claimed in claim 1, wherein the first scan signal, the second scan signal, the third scan signal and the light-emitting signal are all provided by an external timing controller.

4. An active matrix organic light-emitting diode (AMOLED) pixel driving method, which comprises:

Step 1: providing an AMOLED pixel driver circuit, comprising:

a first thin film transistor (TFT), a second TFT, a third TFT, a fourth TFT, a fifth TFT, a sixth TFT, a capacitor, and an organic light-emitting diode (OLED);

the first TFT having the gate connected to a first node, the source connected to a second node and the drain connected to a third node;

the second TFT having the gate connected to a first scan signal, the source connected to a reference voltage, the drain connected to the first node;

the third TFT having the gate connected to a second scan signal, the source connected to a data signal and the drain connected to the second node;

the fourth TFT having the gate connected to a third scan signal, the source connected to the first node and the drain connected to the third node;

the fifth TFT having the gate connected to a light-emitting signal, the source connected to a power supply positive voltage and the drain connected to the third node;

the sixth TFT having the gate connected to the light-emitting signal, the source connected to the second node and the drain connected to the anode of the OLED;

the capacitor having one end connected to the first node and the other end connected to the ground;

the OLED having the anode connected to the drain of the sixth TFT and the cathode connected to the power supply negative voltage;

Step 2: entering an initialization phase:

the first scan signal turning on the second TFT; the second scan signal turning on the third TFT; the third scan signal cutting off the fourth TFT; the light-emitting signal cutting off the fifth TFT and the sixth TFT; the data signal providing an initialization voltage, a reference voltage being written into the first node and the initialization voltage being written into the second node;

Step 3: entering a threshold voltage detection phase:

the first scan signal cutting off the second TFT; the second scan signal turning on the third TFT; the third scan signal turning on the fourth TFT; the light-emitting signal cutting off the fifth TFT and the sixth TFT; the data signal providing a display data voltage; the turned on fourth TFT connecting the gate and the drain of the first TFT; the voltage of the first node reaching the sum of the display data voltage and the threshold voltage of the first TFT; and the voltage of the first node being stored in the capacitor;

Step 4: entering a driving light-emitting phase:

the first scan signal, the second scan signal and the third scan signal cutting off the second TFT, the third TFT and the fourth TFT respectively; the light-emitting signal turning on the fifth TFT and the sixth TFT; the storage effect of the capacitor making the voltage of the first node maintaining the sum of the display data voltage and the threshold voltage of the first TFT; a power supply positive voltage being written into the third node; the first TFT being turned on, the OLED emitting light, and the current flowing through the OLED being independent of the threshold voltage of the first TFT.

5. The AMOLED pixel driving method as claimed in claim 4, wherein the first TFT, the second TFT, the third TFT, the fourth TFT, the fifth TFT and the sixth TFT are all low temperature polysilicon (LTPS) TFTs, oxide semiconductor TFTs or amorphous silicon (a-Si) TFTs.

6. The AMOLED pixel driving method as claimed in claim 4, wherein the first scan signal, the second scan signal, the third scan signal and the light-emitting signal are all provided by an external timing controller.

7. The AMOLED pixel driving method as claimed in claim 4, wherein the first TFT, the second TFT, the third TFT, the fourth TFT, the fifth TFT and the sixth TFT are all N-type TFTs;

in the initialization phase, the first scan signal provides high level voltage, the second scan signal provides high level voltage, the third scan signal provides low level voltage, the light-emitting signal provides low level voltage, and the data signal provides an initialization voltage;

in the threshold voltage detection phase, the first scan signal provides low level voltage, the second scan signal provides high level voltage, the third scan signal provides high level voltage, the light-emitting signal provides low level voltage, and the data signal provides a display data voltage;

in the driving light-emitting phase, the first scan signal, the second scan signal and the third scan signal all provide low level voltage, and the light-emitting signal provides high level voltage.

8. An active matrix organic light-emitting diode (AMOLED) pixel driver circuit, which comprises: a first thin film transistor (TFT), a second TFT, a third TFT, a fourth TFT, a fifth TFT, a sixth TFT, a capacitor, and an organic light-emitting diode (OLED);

the first TFT having the gate connected to a first node, the source connected to a second node and the drain connected to a third node;

the second TFT having the gate connected to a first scan signal, the source connected to a reference voltage, the drain connected to the first node;

the third TFT having the gate connected to a second scan signal, the source connected to a data signal and the drain connected to the second node;

the fourth TFT having the gate connected to a third scan signal, the source connected to the first node and the drain connected to the third node;

the fifth TFT having the gate connected to a light-emitting signal, the source connected to a power supply positive voltage and the drain connected to the third node;

the sixth TFT having the gate connected to the light-emitting signal, the source connected to the second node and the drain connected to the anode of the OLED;

the capacitor having one end connected to the first node and the other end connected to the ground;

the OLED having the anode connected to the drain of the sixth TFT and the cathode connected to the power supply negative voltage;

wherein the first TFT, the second TFT, the third TFT, the fourth TFT, the fifth TFT and the sixth TFT being all low temperature polysilicon (LTPS) TFTs, oxide semiconductor TFTs or amorphous silicon (a-Si) TFTs;

wherein the first scan signal, the second scan signal, the third scan signal and the light-emitting signal being all provided by an external timing controller;

wherein the first scan signal, the second scan signal, the third scan signal, the light-emitting signal and the data signal are combined to correspond to, in sequence, an initialization phase, a threshold voltage detection phase and a driving light-emitting phase;

wherein the first TFT, the second TFT, the third TFT, the fourth TFT, the fifth TFT and the sixth TFT are all N-type TFTs;

in the initialization phase, the first scan signal provides high level voltage, the second scan signal provides high level voltage, the third scan signal provides low level voltage, the light-emitting signal provides low level voltage, and the data signal provides an initialization voltage;

in the threshold voltage detection phase, the first scan signal provides low level voltage, the second scan signal provides high level voltage, the third scan signal provides high level voltage, the light-emitting signal provides low level voltage, and the data signal provides a display data voltage;

in the driving light-emitting phase, the first scan signal, the second scan signal and the third scan signal all provide low level voltage, and the light-emitting signal provides high level voltage.

* * * * *